US008101891B2

(12) United States Patent
Lee et al.

(10) Patent No.: US 8,101,891 B2
(45) Date of Patent: Jan. 24, 2012

(54) COOKING APARATUS

(75) Inventors: Young Woo Lee, Seoul (KR); Wan Soo Kim, Seoul (KR); Hyun Jung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1139 days.

(21) Appl. No.: 11/870,988

(22) Filed: Oct. 11, 2007

(65) Prior Publication Data

US 2008/0087657 A1 Apr. 17, 2008

(30) Foreign Application Priority Data

Oct. 12, 2006 (KR) ..... 10-2006-0099483

(51) Int. Cl.
*A21B 1/26* (2006.01)
*A21B 3/02* (2006.01)
*A21B 3/04* (2006.01)

(52) U.S. Cl. ..... 219/400; 219/391; 126/198

(58) Field of Classification Search ..... None
See application file for complete search history.

(56) References Cited

U.S. PATENT DOCUMENTS

| | | | | |
|---|---|---|---|---|
| 4,716,884 | A * | 1/1988 | Bonaccorsi et al. | 126/198 |
| 5,142,125 | A * | 8/1992 | Fioroli et al. | 219/400 |
| 5,204,503 | A * | 4/1993 | Maiellano et al. | 219/681 |
| 5,447,145 | A * | 9/1995 | Cappello et al. | 126/20 |
| 7,601,932 | B2 * | 10/2009 | Hunter et al. | 219/400 |
| 7,726,295 | B2 * | 6/2010 | Elkasevic | 126/198 |
| 2008/0029078 | A1 * | 2/2008 | Baumann et al. | 126/190 |

FOREIGN PATENT DOCUMENTS

EP 408529 A1 * 1/1991

* cited by examiner

*Primary Examiner* — Joseph M Pelham

(74) *Attorney, Agent, or Firm* — Birch, Stewart, Kolasch & Birch, LLP

(57) ABSTRACT

A cooking apparatus including a cooking chamber that has an opening, a door configured to open and close the opening of the cooking chamber, in which the door has an air-gap to receive pollutants generated in the cooking chamber, and a pollutant discharging unit configured to discharge at least a portion of the pollutants in the air-gap out of the door.

18 Claims, 18 Drawing Sheets

COOKING APARATUS

CROSS-REFERENCE TO RELATED APPLICATIONS

This application claims the benefit of Korean Patent Application No. 10-2006-0099483, filed on Oct. 12, 2006, which is hereby incorporated by reference as if fully set forth herein.

BACKGROUND OF THE INVENTION

1. Field of the Invention

The present invention relates generally to a door of a cooking apparatus and the cooking apparatus including the same, and more particularly, a door of a cooking apparatus having an air-gap to receive pollutants and an pollutant discharge unit located in the door to discharge at least a portion of the pollutants from the air-gap and a cooking apparatus including the same.

2. Description of Related Art

Generally, a related art cooking apparatus includes a cooking chamber for heating food therein using a heater or microwaves. The cooking apparatus usually includes a cabinet surrounding the cooking chamber and a door connected to the cabinet for closing the cooking chamber. In the related art cooking chamber, the external appearance of the cooking apparatus is easily stained because of pollutants generated during the cooking process. These pollutants may take the form of food scraps, sauces, fats, food particulates, and steam generated in the cooking process.

In addition to pollutants on the exterior of the cooking apparatus, pollutants can enter into the interior of the cooling apparatus through a gap in the cooking apparatus, particularly in the interior of the door. Generally, it is more difficult to remove pollutants from the interior of the door as compared to removing pollutants from the exterior of the cooking apparatus and the interior of the cooking chamber. Furthermore, in some cases, a user of the cooking apparatus may not know that pollutants have entered into the interior of the door and, subsequently, the pollutants may cause a bad smell due to the rotting of the pollutants in the door of the cooking apparatus. Therefore, it is difficult to maintain the cleanness of the cooking apparatus quality of the cooking apparatus may be deteriorated over time.

BRIEF SUMMARY OF THE INVENTION

Accordingly, the present invention has been proposed in order to solve one or more the above problems regarding the related art cooking apparatuses. It is an object of the present invention to provide a cooking apparatus capable of maintaining the cleanness of the cooking apparatus by discharging the pollutants that have entered into the inner space by gravity.

According to an aspect of the present invention, there is provided a cooking apparatus that includes a cooking chamber that has an opening, a door configured to open and close the opening of the cooking chamber, in which the door has an air-gap to receive pollutants generated in the cooking chamber, and a pollutant discharging unit configured to discharge at least a portion of the pollutants in the air-gap out of the door.

According to another aspect of the present invention, there is provided a cooking apparatus that includes a cooking chamber having an opening, a door configured to open and close the opening of the cooking chamber, in which the door has a front surface, a back surface, and an air-gap to receive pollutants generated in the cooking chamber; and a pollutant discharging unit configured to return at least a portion of the pollutants in the air-gap through the back surface of the door to the cooking chamber.

According to yet another aspect of the present invention, there is provided a door of a cooking apparatus. The door includes a first door panel, a second door panel spaced from the first door panel, an air-gap located between the first door panel and the second door panel, in which the air-gap is configured to receive pollutants therein, and a pollutant discharging unit located in the air-gap. The pollutant discharge unit is configured to discharge pollutants in the air-gap out of the door.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION OF THE INVENTION

Reference will now be made in detail to exemplary embodiments of a cooking apparatus according to the present invention, examples of which are illustrated in the accompanying drawings. Wherever possible, the same reference numbers will be used throughout the drawings to refer to the same or like parts.

Figure 1:
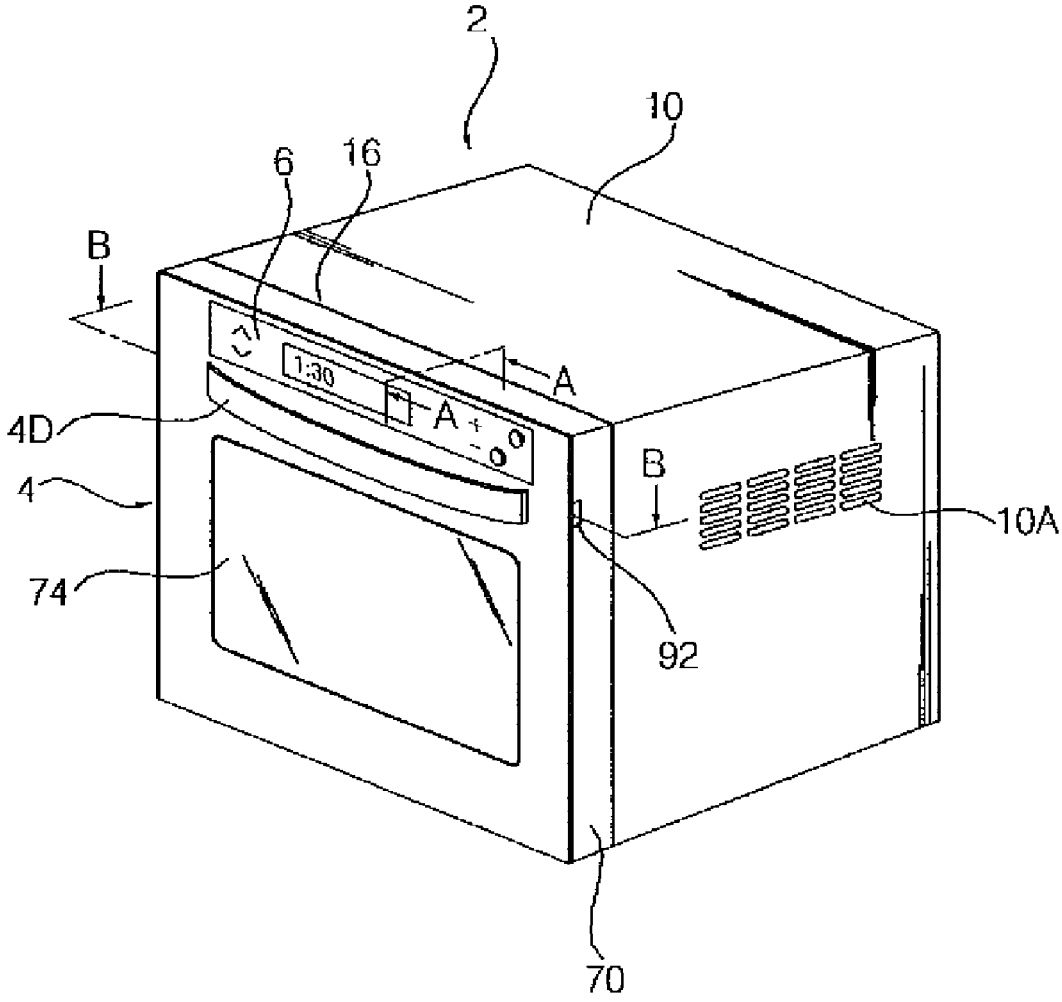
FIG. 1 is a perspective view of an external appearance of a cooking apparatus according to a first embodiment of the present invention when the door thereof is closed.
Figure 2:
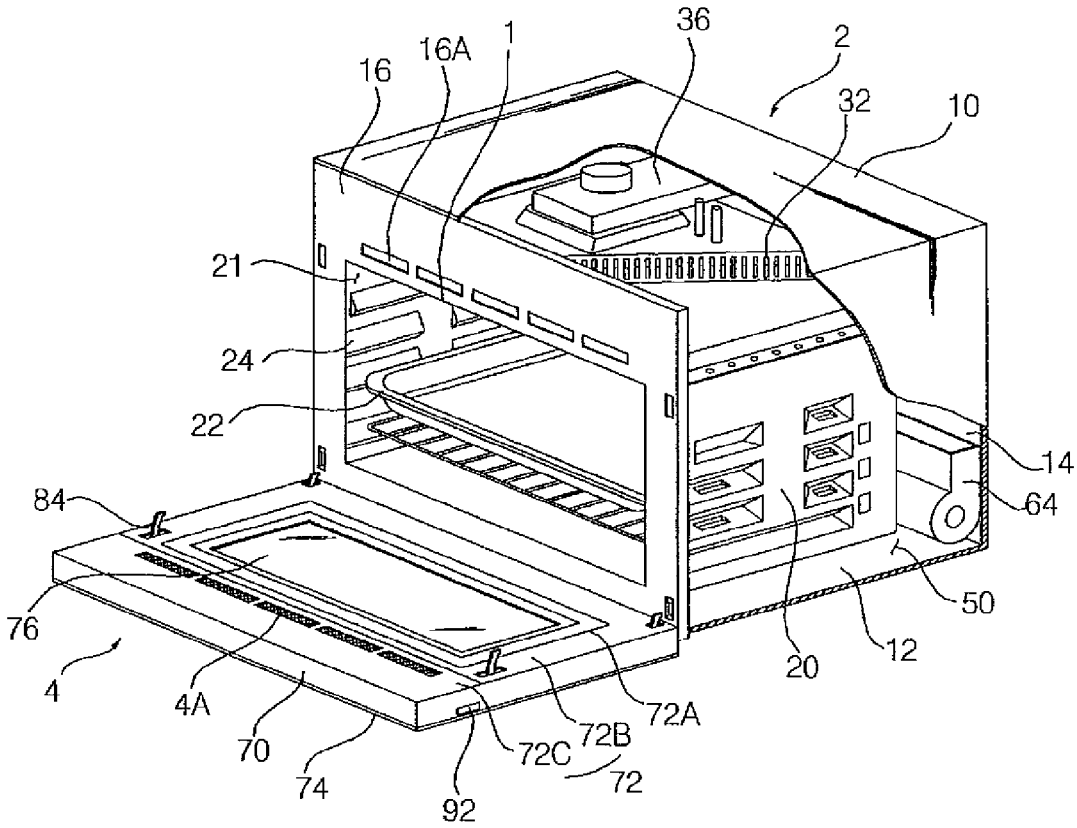
FIG. 2 is a perspective view of the cooking apparatus of FIG. 1 where the door thereof is opened and with a portion of the cabinet removed.

As shown in FIGS. 1 and 2, a cooking apparatus according to the present embodiment includes a cabinet 2 having an opening 1 located in the front surface thereof. A door 4 is hingedly attached to the cabinet 2 so that the opening 1 can be opened and closed. A control panel 6 is installed in either the cabinet 2 or the door 4 and allows a user to control the operation of the cooking apparatus or to see the current operating conditions of the cooking apparatus. The door includes an air-gap 3, which will be described in greater detail below.

The cabinet 2 includes a frame 10 that defines right and left surfaces and an upper surface of the cabinet 2, a base 12 disposed on a lower side of the frame 10 to form a bottom of the cabinet 2, a rear plate 14 disposed at the rear of the frame 10 to form a rear surface of the cabinet 2, and a front plate 16 disposed in the front of the frame 10. The front plate 16 includes the opening 1 therein. A cabinet inlet is formed in at least one of the right surface of the frame 10, the left surface of the frame 10, and the rear plate 14 so that external air can be sucked into the inside of the cabinet 2.

At least one cabinet outlet 16A is formed in the front plate 16 so that the air in the inside of the cabinet 2 can be discharged out of the cabinet 2. The cabinet outlet 16A can be positioned in the part opposed to the door 4 when the door 4 is closed so that cooling air flow provided by a cooling unit 60 is discharged from the cabinet 2 through the cabinet outlet 16A to air-cool the door or the control panel 6. In particular, the cabinet outlet 16A can be positioned on the upper side of the opening 1. The cabinet outlet 16A can be formed in a slot shape that extends in the right and left directions of the cabinet 2. As shown in FIG. 2, a plurality of cabinet outlets 16A are arranged in the right and left directions of the cabinet 2. The opening 1 can be positioned in the up and down directions of the cabinet 2 so that it can cooperate with the cooking chamber opening 21.

The inside of the cabinet 2 is provided with a cooking chamber 20 where food is received and cooked. The cooking chamber 20 can be positioned in the up and down directions within the cabinet 2. The cooking chamber 20 has a cooking chamber opening 21 corresponding to the opening 1 in the front surface thereof so that food can be placed in and removed from the cooking chamber 20. The cooking chamber opening 21 can be opened and closed by the door 4.

A rack 22 is located in the cooking chamber 20, and is configured to support food therein. Rack rails 24 may be provided on the respective right and left inner walls of the cooking chamber 20 to support the edges of the rack 22, thereby allowing the rack 22 to be inserted into and removed from the cooking chamber 20. By providing a plurality of rack rails 24 in the respective up and down directions of the cooking chamber 20, the up and down position of the rack 22 in the cooking chamber 20 can be controlled.

The inside of the cabinet 2 is provided with one or more heat sources for heating the inside of the cooking chamber 20. For example, in order to uniformly disperse heat while the temperature of the inside of the cooking chamber 20 rapidly rises and to provide for different types of cooking, a variety of different heat sources may be provided. The heat sources include an upper heat source that provide heat from the upper side of the cooking chamber 20 to the cooking chamber 20. In this exemplary embodiment, the upper heat source can include an upper heater 32 positioned on the upper side of the cooking chamber 20 to be heat-generated by electricity. The heat sources also include a lower heat source that provides heat from the lower side of the cooking chamber 20 to the cooking chamber 20. The lower heat source can include a lower heater 34 positioned on the lower side of the cooking chamber 20 to be heat-generated by electricity. The upper heater 32 can provide heat to the cooking chamber 20 in a conductive manner and can provide heat source to the cooking chamber 20 in a convection manner by being connected to the cooking chamber 20 through a lower heater duct (not shown). The heat sources include a magnetron 36 capable of providing a high frequency heat source to the inside of the cooking chamber 20. The magnetron 36 can be located on the upper side of the cooking chamber 20 in the cabinet 2. Finally, the heat source can include a convection heat source 40 positioned in the rear of the cooking chamber 20 to provided forced convection heat to the cooking chamber 20.

Also, in the inside of the cabinet 2, a machine room 50 is positioned in the rear of the cooking chamber 20 in the cabinet or on the upper side of the cooking chamber 20 and is connected to the control panel 6 to be communicable therewith to control the operation of the cooking apparatus including the heat sources. Also, a cooling unit 60 capable of cooling the machine room, the door 4, and/or the control panel 6 is provided inside the cabinet 2.

The cooling unit 60 includes a blowing channel 62 connecting the cabinet inlet 10A to the cabinet outlet 16A. The blowing channel is provided outside the cooking chamber 20 in the cabinet 2 so as to pass through the machining room 50. A blower 64 is positioned in the blowing channel 62 and provides cooling airflow from the cabinet inlet 10A towards the cabinet outlet 16A. The blowing channel 62 can be a duct structure. Also, since the machine room is positioned at the rear of the cooking chamber 20 in the cabinet 2 or on the upper side of the cooking chamber 20, the rear of the cooking chamber 20 in the cabinet 2 and the upper side of the cooking chamber 20 can serve as the blowing channel 62. The blower 64 can be positioned in the rear of the cooking chamber 20 in the cabinet 2, it can be positioned to the right and left of the cooking chamber 20 in the cabinet 2, and it can be positioned on the upper side of the cooking chamber 20 in the cabinet 2.

The door 4 is pivotally connected to the cabinet 2 through a hinge (not shown) such that it can move between an open position and a closed position while being rotated up and down about the lower side of the door 4. Also, the door 4 can be locked in the state that the door is closed or can be connected to the cabinet 2 through a door latch 84. For convenience' sake of explanation hereinafter, because the door 4 is stood approximately vertical when the door is closed and is approximately horizontal when the door is opened, the length of the door 4 in the up an down directions when the door 4 is closed is referred to as the length of the door 4, the length of the door 4 in the right and left directions when the door 4 is closed is referred to as the width of the door 4, the depth of the door 4 in the front and rear directions when the door 4 is closed is referred to as the thickness of the door 4, and the side of the door opposite the hinge is referred to as the upper side of the door 4.

The door 4 includes a first door panel 70 forming a front surface on the outside of the door 4 furthest from the cooking chamber 20, and a second door panel 72 forming a back surface on the inside of the door 4 that is positioned between the first door panel 70 and the cooking chamber 20 when the door 4 is closed. An air-gap 3 is formed between the first door panel 70 and the second door panel 72. The first door panel 70 may have a box shape and include a first opening 70B, which is shielded by the second door panel 72. The first door panel 70 is sized to cover the opening 1 in the cabinet 2 as well as the front plate 16 of the cabinet 2.

In the first door panel 70, a first outer opening 70D allows the interior of the cooking chamber 20 to be viewed through the door 4. The first outer opening 70D may be sized to correspond to the cooking chamber opening 21 so that the inside of the cooking chamber 20 can be seen when the door 4 is closed. An outer glass 74 is attached to the first door panel 70 to cover the first outer opening 70D. The outer glass 74 may be sized to cover the first outer opening 70D as well as the whole first door panel 70. The outer glass 74 is positioned in an exterior surface of the first door panel 70 when the door 4 is closed.

Figure 3:
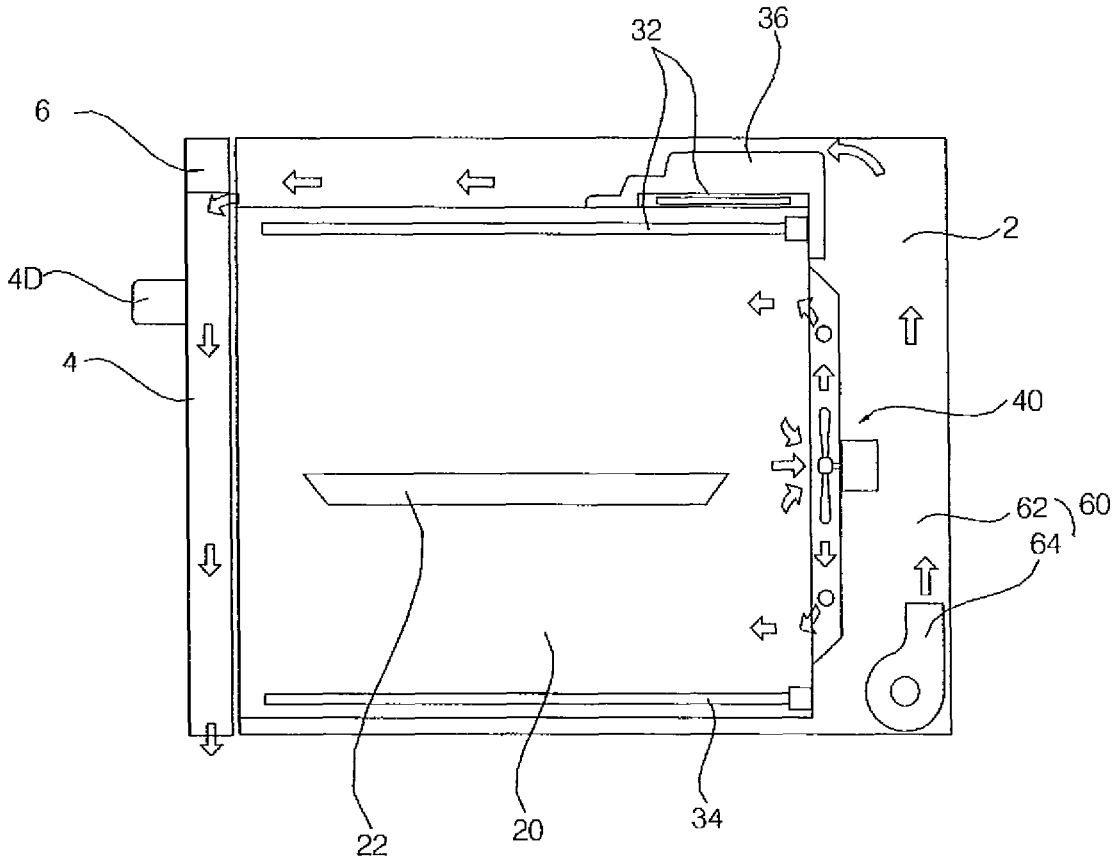
FIG. 3 is a schematic view of a cooking apparatus according to a first embodiment of the present invention.

The second door panel 72 is coupled to the first door panel 70 so that it shields the first opening 70B. The second door panel 72 can be formed as a single door panel or divided into two or more door panels. As shown in FIGS. 1 and 3, the second door panel 2 includes a base panel 72B, and an upper panel 72C disposed above the base panel 72B. In the second door panel 72, a second door panel opening 72A is provided so that the interior of the cooking chamber 20 is visible through the door 4. The second door panel opening 72A is positioned in the base panel 72B to correspond to the cooking chamber opening 21 so that the inside of the cooking chamber 20 is visible when the door 4 is closed. In the second door panel opening 72A, an inner glass 76 configured to shield the second door panel opening 72A is disposed. Also, the lower side of the second door panel 72 can be provided with a part of the hinge (not shown). The upper side of the second door panel 72 is provided with a part of the door latch 84.

Also, a middle glass 78 is provided in the door 4 between the first door panel 70 and the second door panel 72 that divides the air-gap 3 in a thickness direction of the door 4. The portion of the air-gap 3 between the middle glass 78 and the first door panel 70 is open and the portion of the air-gap 3 between the middle glass 78 and the second door panel 72 is air-tight.

To assist in cooling the door during and after a use of the cooking apparatus, the door includes an opening 4A allowing one side of the air-gap 3 and the exterior of the door 4 to be in communication with each other, and an opening 4B allowing other side of the air-gap 3 and the exterior of the door to be in communication with each other. The opening 4A and the opening 4B can be spaced from each other in a length direction of the door 4 and can be spaced from each other in a width direction in order that the whole door 4 can be evenly air-cooled. For example, the opening 4A is positioned on the upper side of the door 4 and the opening 4B is positioned on the lower side of the door 4.

Figure 4:
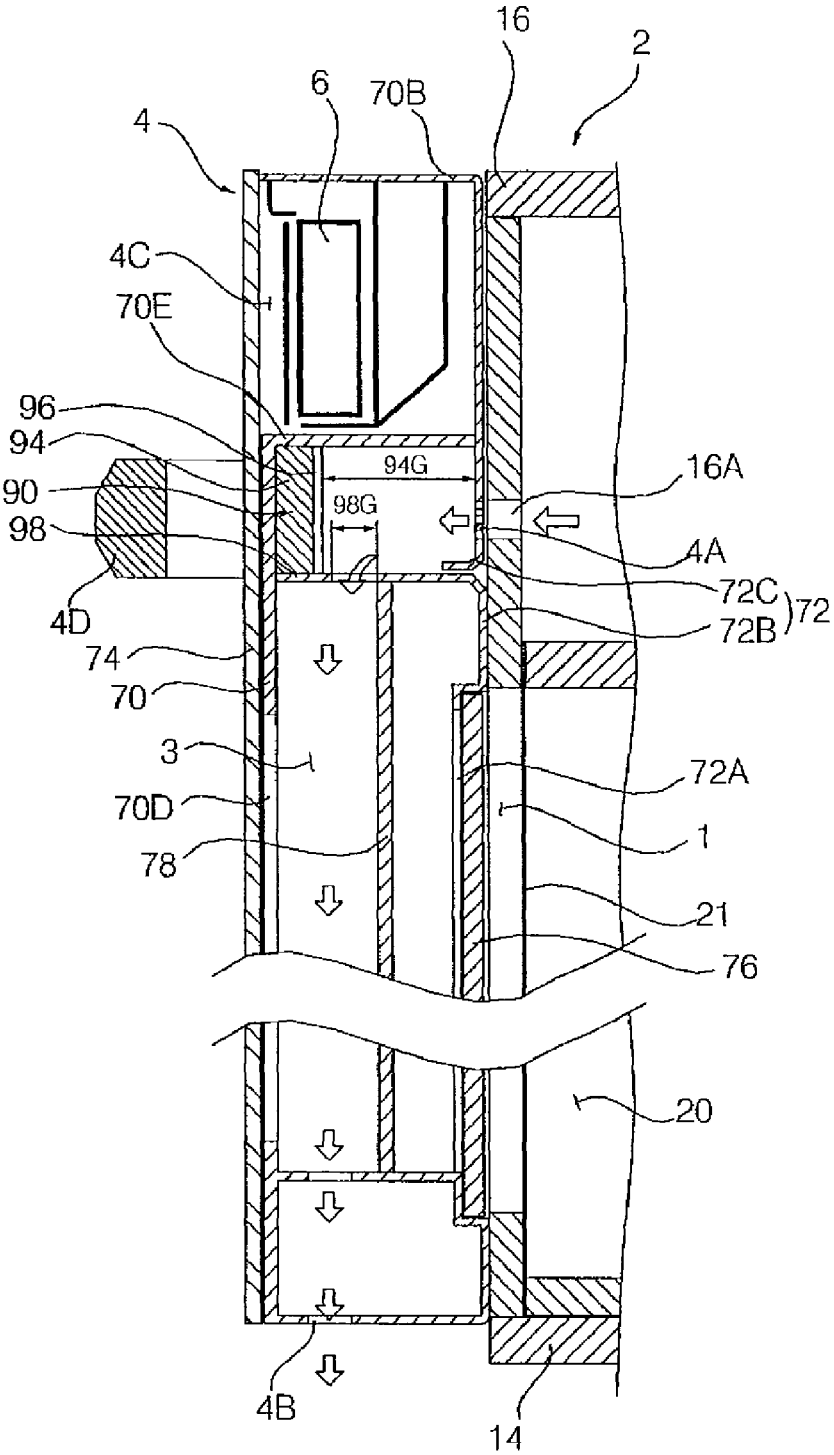
FIG. 4 is a cross-sectional taken along line A-A in FIG. 1.

The opening 4A is connectable to the blowing channel 62 when the door 4 is closed, in particular, so that the door 4 can be air-cooled by the cooling air flow from the cooling unit 60. In particular, the opening 4A is formed in the upper panel 72C so that the it can be in communication with the cabinet outlet 16A when the door 4 is closed. Because the opening 4A is exposed to the outside when the door 4 is opened, it can be provided with a porous structure in order to minimize the infiltration of pollutants. For example, the opening 4A may be provided in the shape of a mesh or may be provided with a plurality of louvers or slot frames arranged in the up and down directions or left and tight directions of the door 4. The opening 4B can be formed in one of the first door panel 70 and the second door panel 72. As shown in FIG. 4, the opening 4B is located in the first door panel 70.

In this first exemplary embodiment, the control panel 6 is located in the a control panel portion 4C of the door 4. The control panel portion 4C is positioned above the air-gap 3. A bracket 70E separates the control panel portion 4C from the air-gap 3. The bracket 70E can be integrally formed in the first door panel 70.

The door 4 includes a door handle 4D graspable by a user to allow the user to facilitate the opening and closing of the door 4. The door handle 4D can be positioned in the upper side of the door 4 below the control panel 6 to avoid interfering with the control panel 6 and to be rapidly cooled by the cooling unit 60. The door handle 4D projects away from the outer glass 74 to allow the user to easily grasp it. In other words, each of the left an right ends of the door handle 4D is contacted and coupled to the door outer glass 74 and the remaining portion of the door handle 4D is spaced from the outer glass 74 so that the user's hand can be inserted between the door handle 4D and the outer glass 74.

The door 4 includes a pollutant discharging unit to easily discharge pollutants, such as food, dust, and moisture, etc., collected in the air-gap 3 out of the door 4. The pollutant discharging unit can include a pollutant discharge guide 90 such that the pollutants in the air-gap 3 are automatically discharged by gravity without using power such as electricity, etc. In particular, if the door 4 is opened to be approximately horizontal, the pollutant discharge guide 90 can discharge the pollutants in the air-gap 3 out of the door 4 by the gravity. In particular, the pollutant discharge guide 90 includes a pollutant discharge opening 92 formed on at least any one of the left and right sides of the door 4, and a pollutant discharge member 94 having at least one sloped to guide pollutants along the width direction of the door 4 to the pollutant discharge openings 92.

The pollutant discharge openings 92 include a left pollutant discharge opening 92A formed on the left surface of the door 4 and a right pollutant discharge opening 92B formed on the right surface of the door 4 so that the pollutants in the air-gap 3 can rapidly be discharged to the left and right of the door. The pollutant discharge opening 92 can is aligned with the pollutant discharge guide 94 in the width direction of the door 4 in order to assist in the rapid removal of pollutants in the air-gap 3.

The pollutant discharge member 94 contacts the first door panel 70 and projects from the first door panel 70 towards the second door panel 72, in particular, the upper panel 72C of the second door panel 72. The pollutant discharge member 94 may be separately manufactured from the first door panel 70 so that it can be fixed to the first door panel 70 by various means including fastening, welding, bonding, etc. Alternatively, the pollutant discharge unit may be integrally manufactured with the first door panel 70. The pollutant discharge member 94 is disposed in a straight line in the left and right directions of the door 4 to assist in the discharge of pollutants in the air-gap 3.

Figure 6:
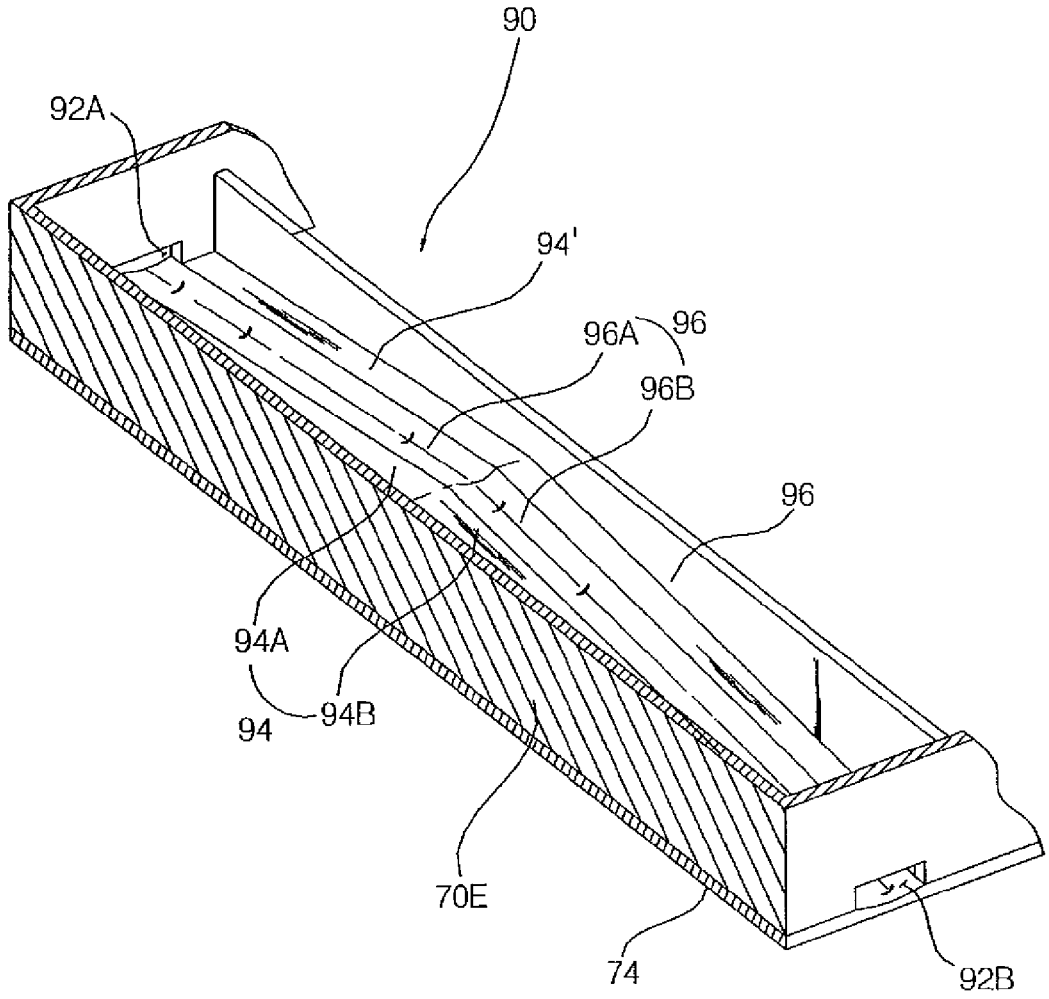
FIG. 6 is a perspective internal view of a pollutant discharging unit according to the first embodiment of the present invention of FIG. 2.

The slope surface 94' of the pollutant discharge guide 94 may have a curved surface of predetermined curvature, as shown in FIG. 6, or it can be formed with a smooth a plane. However, it is preferably that the slope surface 94' does not having a deeply recessed part in which the pollutant in the air-gap 3 may be collected. The inclined angle of the slope surface 94' of the pollutant discharge member 94 can be determined by considering several factors, such as the thickness of the air-gap 3, the width of the air-gap 3, the kinds of the pollutants usually infiltrated in the air-gap 3, etc.

Figure 5:
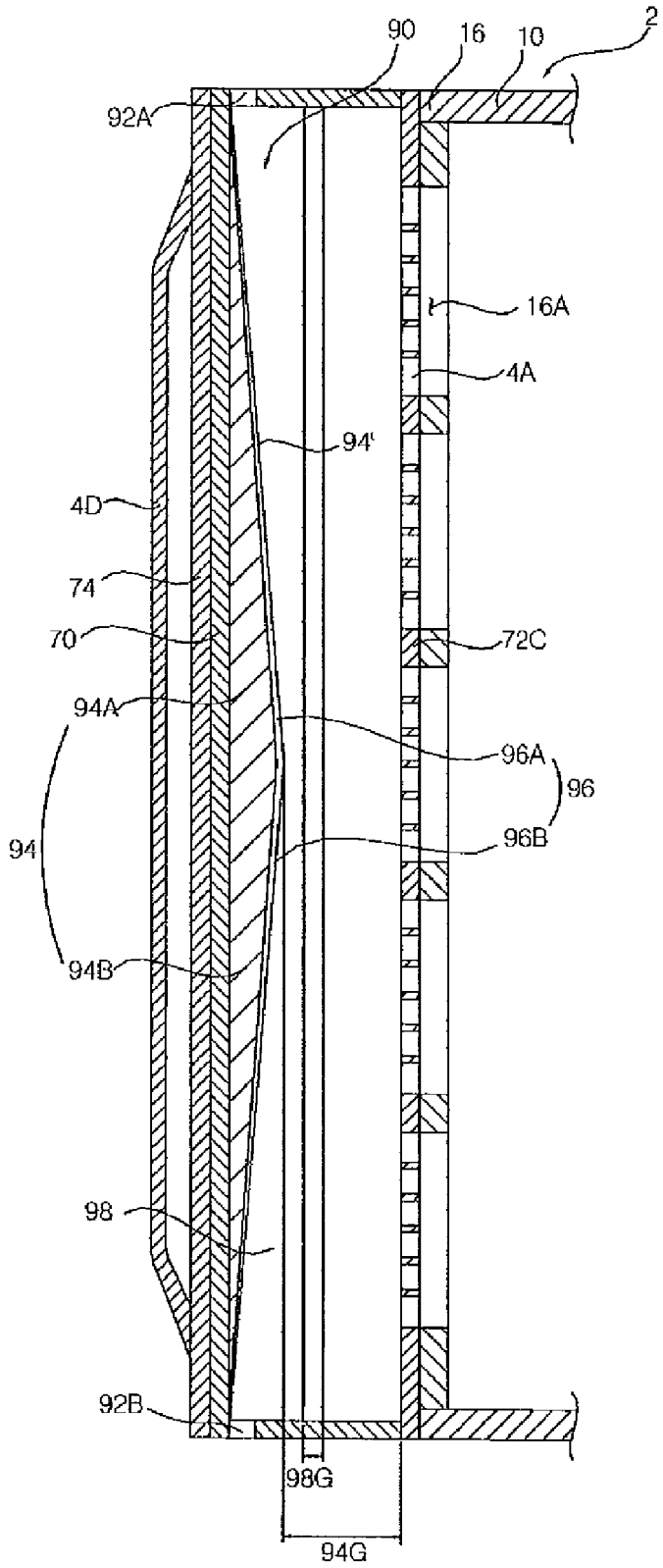
FIG. 5 is a cross-sectional view taken along line B-B in FIG. 1.

The pollutant discharge member 94 includes a left part 94A connected to the left pollutant discharge opening 92A and a right part 94B connected to the right pollutant discharge opening 92B so that the pollutants in the air-gap 3 can rapidly be discharged through the left and right side slots 92A and 92B. Each of the left and right parts 94A and 94B of the pollutant discharge member 94 can be connected to each other in order to prevent the collection of pollutants. Each of the left and right parts 94A and 94B of the pollutant discharge member 94 may be arranged to contact the second door panel 72, however, as shown in FIG. 5 the pollutant discharge member 94 is preferably arranged to maintain a predetermined gap 94G with the second door panel 72 in order to allow the smooth flow of air through the air-gap 3.

The pollutant discharge member 94 may further include a groove 96 formed in the slope surface 94' and is in communication with the pollutant discharge openings 92 in order to more smoothly discharge the pollutants in the air-gap 3. The groove 96 includes a left part 96A formed in the left part 94A of the pollutant discharge member 94 and a right part 96B formed in the light part of the pollutant discharge member 94. The left and right parts 96A and 96B of the groove 96 can be connected to each other. While each of the left and right parts 96A and 96B of the groove 96 are shown as having a semicircular cross-section, the left and right parts 96A and 96B may have a polygonal cross-section, such as a triangle, a square, a pentagon, etc. In addition, they can have other cross-sectional shapes.

The pollutant discharge guide 90 may occupy only a portion of the air-gap 3 or occupy the entire air-gap 3. In the present embodiment, because the pollutants are mainly infiltrated through the opening 4A when the door 4 is closed, the pollutant discharge guide 90 is provided in only a part of the air-gap 3. In particular, the pollutant discharge guide 90 is located at the upper side of the air-gap 3 and positioned opposite the opening 4A.

The door 4 can further include a barrier 98 partitioning the air-gap 3 along the length direction of the door 4. The barrier 98 can be located near the pollutant discharge guide 90 along the length direction of the door 4 so that the pollutants infiltrated through the opening 4A can be collected in the pollutant discharge guide 90. Because the pollutant discharge guide 90 is positioned in the upper side part of the air-gap 3, the barrier 98 can be positioned below the air-gap 3 along the length direction of the door 4. The barrier 98 projects from the first door panel 70 to the second door panel 72. In this exemplary embodiment, the barrier 98 maintains a predetermined gap with the second door panel 72 so that the flow of the cooling airflow of the cooling unit 60 can be maintained. In particular, when the barrier 98 cooperates with the middle glass 78, as shown in FIG. 4, it can be arranged to maintain a predetermined gap 98G with the middle glass 78 in the thickness direction of the door 4. The barrier 98 can be formed of thermal conductive material to allow the door 4 to be sufficiently air-cooled by the cooling airflow of the cooling unit 60. Consequently, the barrier 98 is positioned opposite the door handle 4D in the length direction of the door 4, thereby reinforcing the door handle 4D side and allowing the door handle 4D to be more rapidly cooled.

As shown in FIG. 4, the control panel 6 is located in the control panel portion 4C and is integrally provided in the door 4. The control panel 6 may include several input parts for operating the cooking apparatus, such as whether the door latch 84 is locked, whether the heat source of the cooking chamber 20 is operated, etc. In addition, various display parts displaying a current state of the cooking apparatus is provided in the control panel 6.

The cooking apparatus according to the first exemplary embodiment may be operated to heat food or to perform a self-cleaning function. In order to heat food, a user opens the door 4 and puts food on the rack 22 in the cooking chamber 20 and then closes the door 4. Then the user operates the control panel 6 to input a cooking mode for cooking the food in the cooking chamber 20. The user operates the control panel 6 to input the cooking information or the preset algorithm, etc. so that at least one of the heat sources of the cooking chamber, such as the upper heater 32, the lower heater 34, the magnetron 36, and/or the convection heat source 40, is operated.

If the upper heater 32 is operated, the heat source by the upper heater 32 is supplied from the upper side of the cooking chamber 20 to the inside of the cooking chamber 20 by thermal conduction and thermal convection. If the lower heater 34 is operated, the heat source by the lower heater 34 is supplied to the inside of the cooking chamber 20 by thermal conduction or thermal convection. If the magnetron 36 is operated, high frequency waves generated from the magnetron 36 is supplied to the inside of the cooking chamber 20. If the convection heat source 40 is operated, the heat source of the convection heat source 40 is supplied to the cooking source 20 while being formed with compulsion convection.

As described above, if the inside of the cooking chamber 20 is supplied with at least one of the heat sources, the food in the cooking chamber 20 is cooked in the cooking mode and the pollutants in the cooking chamber 20 can be thermally decomposed and cleaned in the self cleaning mode.

In addition, as described above, if the inside of the cooking chamber 20 is heated to a high temperature, such as 500° C. or more, the heat from the hot air inside the cooking chamber 20 is transferred to the door 4, the control panel 6, and the machining room 50 in the cabinet 2 Accordingly, in the cooking mode, as well as in the self cleaning mode, the cooling unit 60 is operated to cool the door 4, the control panel 6, and the machining room 50 in the cabinet 2 as follows.

When the blower 64 is operated, a cooling airflow from the outside of the cooking apparatus is sucked into the blowing channel 62 in the cabinet 2 through the cabinet inlet 10A. The cooling airflow in the blowing channel 62 flows toward the cabinet outlet 16A along the blowing channel 62 to cool the machining room 50 in the cabinet 2. Because the cabinet outlet 16A and the opening 4A are in communication with each other, the cooling airflow arriving at the cabinet outlet 16A flows into the air-gap 3 through the cabinet outlet 16A and the opening 4A and is discharged from the door 4 to the outside of the cooking apparatus through the opening 4B.

Because the cooling airflow flows through the air-gap 3 to the opening 4B along the air-gap 3, the airflow cools the door 4. As a result, when the user contacts the door 4, particularly the door handle 4D, the user does not get burned. Because of the arrangement of the cooling duct 62 and the opening 4A, the cooling airflow is sucked through the opening 4A and flows downwardly along the air-gap 3 to provide a buffer between the control panel 6 and the hot air generated from the high temperature of the cooking chamber 20 so that the hot air does no flow to the control panel 6. As a result, the control panel 6 remains cool to the touch.

Figure 7:
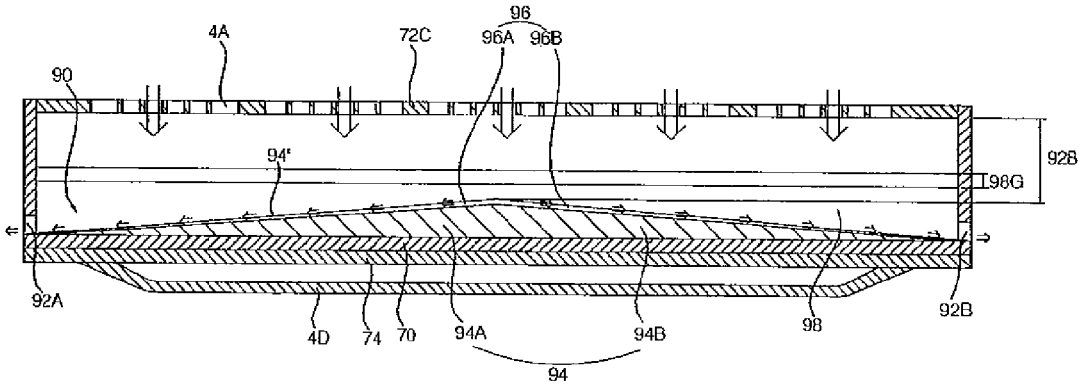
FIG. 7 is a cross-sectional view showing the flow of pollutants through the pollutant discharging unit according to the first embodiment of the present invention.

After the cooking mode or the self cleaning mode is completed, if the user holds the door handle 4D and pulls up it forwardly so that the door 4 is disposed to be approximately horizontal, the inside of the cooking chamber 20 can be cleaned and any thermally decomposed pollutants can be removed. In addition, as shown in FIG. 7, the pollutants positioned in the pollutant discharge member 94 are moved towards the left and right pollutant discharge openings 92A and 92B along the pollutant discharge member 94 by gravity so that they are discharged to the outside.

Further, when the door 4 is opened to be approximately horizontal, washing water may be injected into the inside of the air-gap 3 through the opening 4A so that the pollutants in the air-gap 3 are swept by the injected washing water, making it possible to more rapidly discharge the pollutants and wash the air-gap 3.

Figure 8:
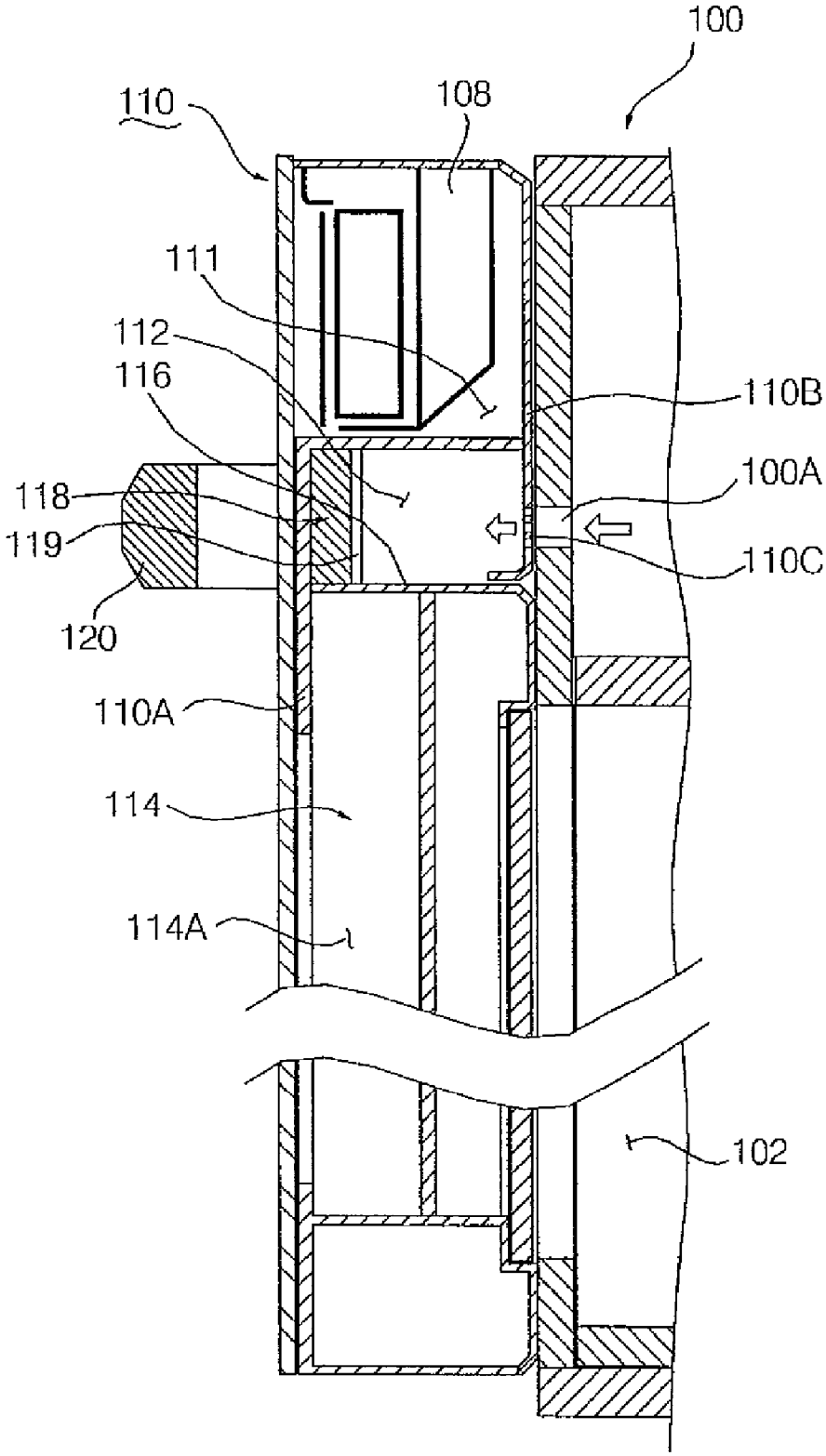
FIG. 8 is a partial cross-sectional view of a cooking apparatus according to a second embodiment of the present invention and is similar to FIG. 4.
Figure 9:
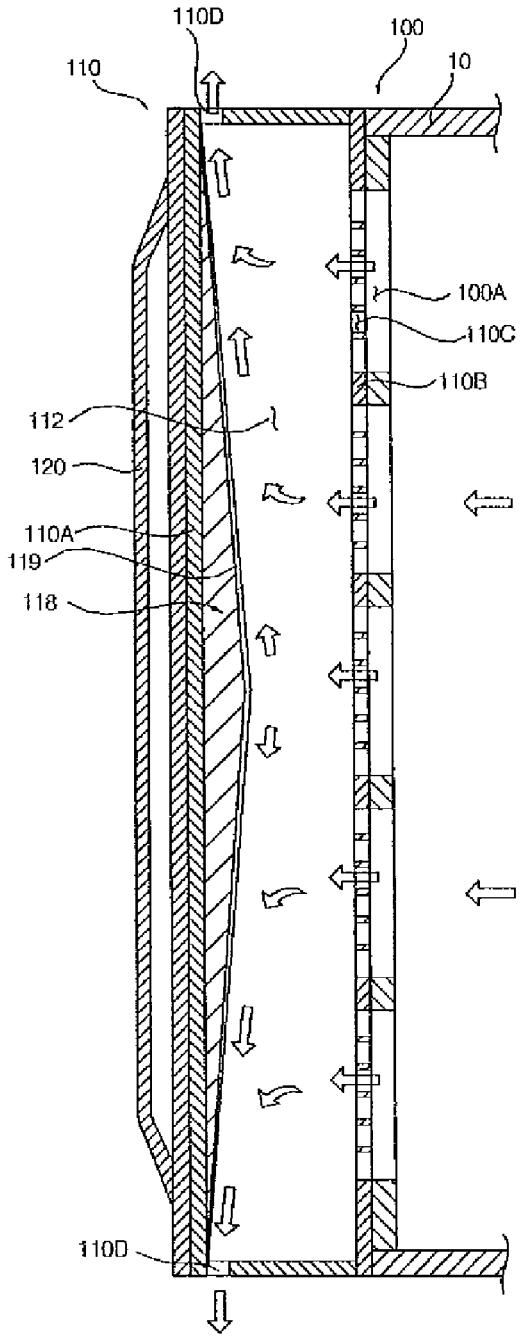
FIG. 9 is a partial cross-sectional view of a cooking apparatus according to the second embodiment of the present invention and is similar to FIG. 5.
Figure 10:
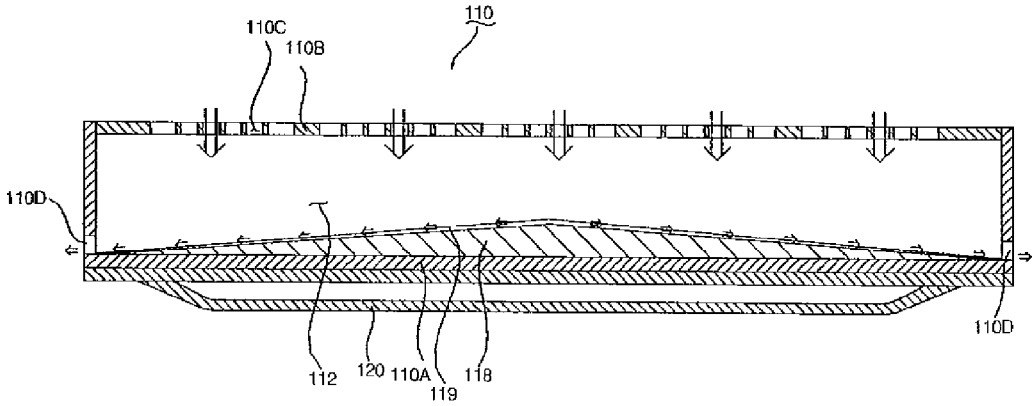
FIG. 10 is a partial cross-sectional view a cooking apparatus according to the second embodiment of the present invention and is similar to FIG. 7.

A second exemplary embodiment of the cooking apparatus according to the present invention is shown in FIGS. 8-10. Features of the cooking apparatus according to the exemplary embodiment, with the exception of the door structure, are similar to those described above and thus further description will be omitted unless necessary for the understanding of the invention.

In the cooking apparatus according to the second exemplary embodiment, the inside of a cabinet 100 is provided with a cooking chamber 102, a cooking chamber heat source, a machining room, and a blower forming a cooling airflow. The outside of the cabinet 100 includes a door 110 opening and closing the cooking chamber 102 and includes a control panel integrally formed therewith. One side of the cabinet 100 is provided with a cabinet inlet for sucking external air by the blower. The upper side of the front of the cabinet 100 is provided with a cabinet outlet 100A exhausting the air in the cabinet 100 by the blower.

The door 110 includes a control panel portion 111 in which the control panel 108 is disposed, an air-gap 112 capable of flowing the cooling airflow and positioned at the lower side of the control panel portion 111, and a door base part 114 for viewing the cooking chamber 102 therethrough is positioned at the lower side of the air-gap 112, along the length direction of the door 110.

The air-gap 112 and the door base part 114 is interrupted by a barrier 116 disposed between the air-gap 112 and the door base part 114. The barrier 116 is formed of thermal conductive material so that the door can be cooled by a cooling airflow flowing in the air-gap 112. The door base part 114 can include an air-tight air-gap 114A for viewing through the door 110. The door 110 includes a door handle 120 at the position corresponding to the air-gap 112.

One side of the air-gap 112 is in communication with the opening 110C formed in the door 110 so that it can be placed in communication with the cabinet outlet 100A when the door 110 is closed. For example, the opening 110C can be positioned in the inner surface of the door 110, that is, a second door panel 110B of the door 110 nearest the cooking chamber 102. The other side of the air-gap 112 is in communication with the opening 110D formed in the door 110 so that the air inside the air-gap 112 can be discharged outside of the door 110 and the cooking apparatus.

The opening 110D can be positioned in the upper side of the air-gap 112 when the door 110 is closed to guide the air inside the air-gap 112 into the control panel 108 and it can be positioned in the outer surface of the door 110, that is, a first door panel 110A of the door 110 furthers from the cooking chamber 102. In this exemplary embodiment, openings 110D are positioned on the left and right surfaces of the door 100. The opening 110D can be formed to have a porous structure.

In the door 110, the air-gap 112 includes a pollutant discharge member 118 that discharges pollutants in the air-gap 112 through pollutant discharge openings formed on the left and right surfaces of the door 110 by gravity when the door is opened to be approximately horizontally disposed. In this exemplary embodiment, the openings 110D can perform the function of the pollutant discharge openings. The pollutant discharge member 118 includes a groove 119 in communication with the openings 110D.

If the door 110 is opened to be approximately horizontal, the pollutants in the air-gap 112 is moved to the openings 110D along the pollutant discharge member 118 by gravity so that they are discharged out of the door 110 and the cooking apparatus through the openings 110D. If the blower is operated with the door 110 in the closed position, the air exhausted from the cabinet outlet 100A flows in the air-gap 112 through the opening 110C and is then discharged through the openings 110D. Accordingly, the door 110 and the door handle 120 is cooled and the flow of hot air due to the high temperature of the cooking chamber 102 is interrupted so as not to be transferred to the control panel 108.

Figure 11:
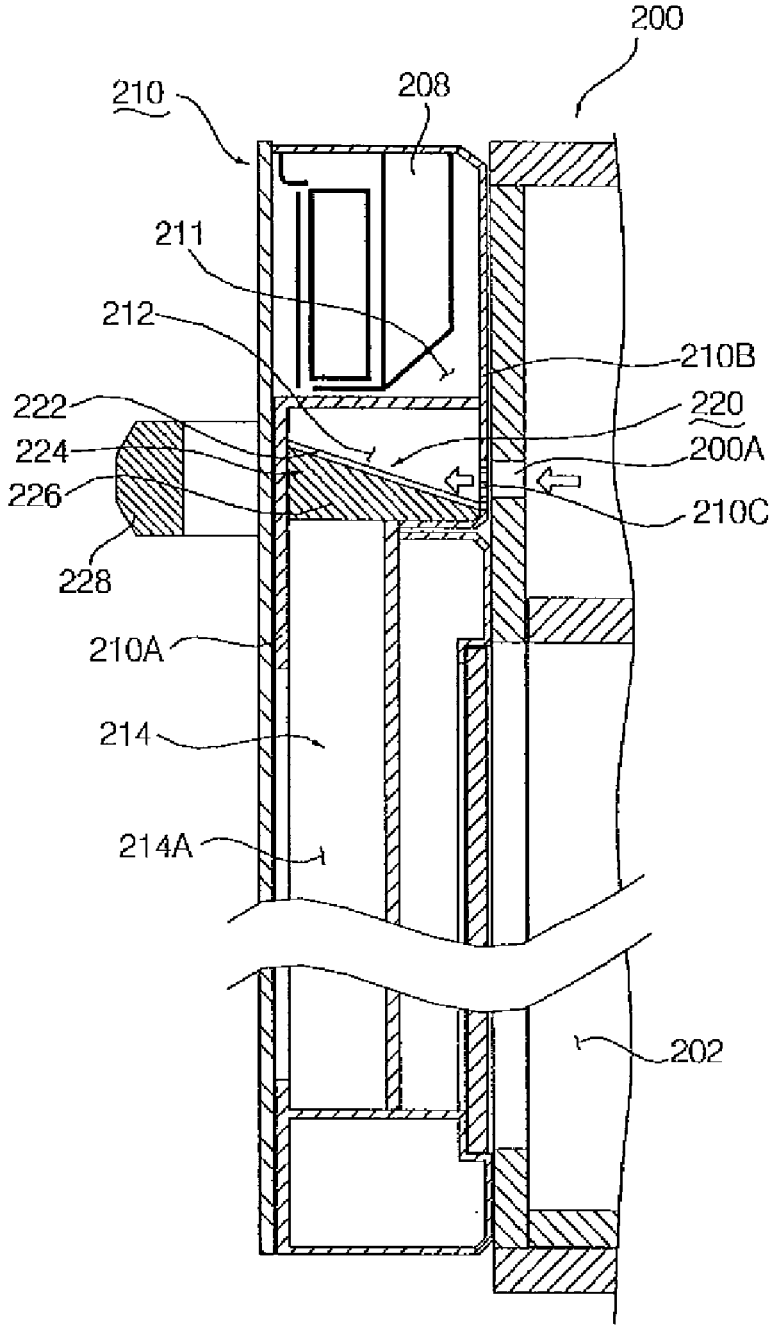
FIG. 11 is a partial cross-sectional view of a cooking apparatus according to a third embodiment of the present invention and is similar to FIG. 4.
Figure 12:
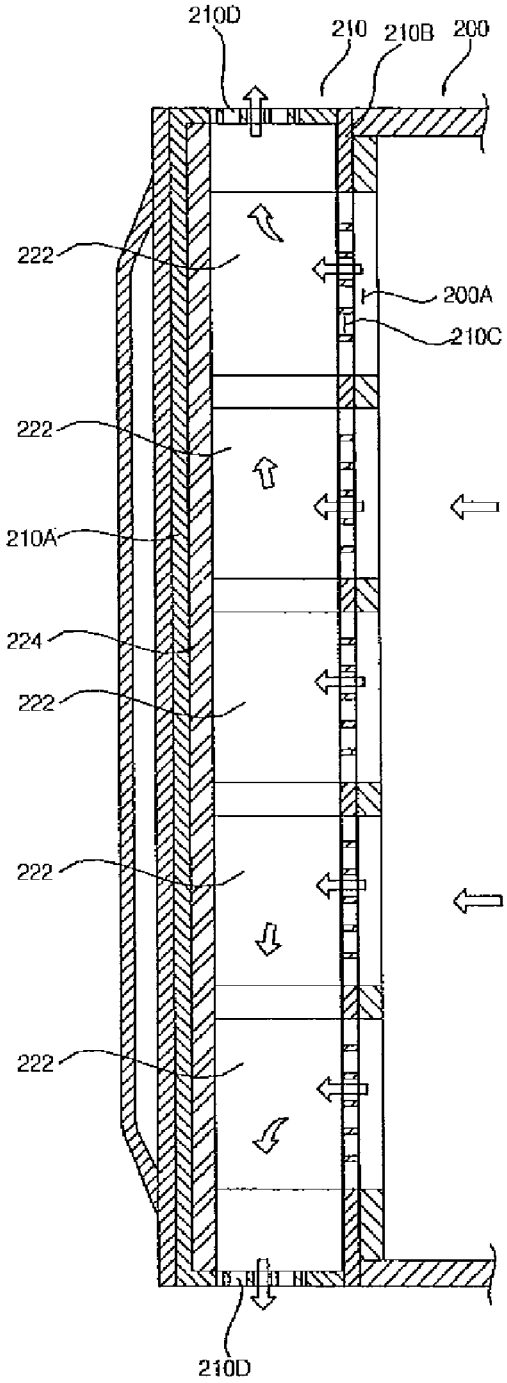
FIG. 12 is a partial cross-sectional view of a cooking apparatus according to the third embodiment of the present invention and is similar to FIG. 5.
Figure 13:
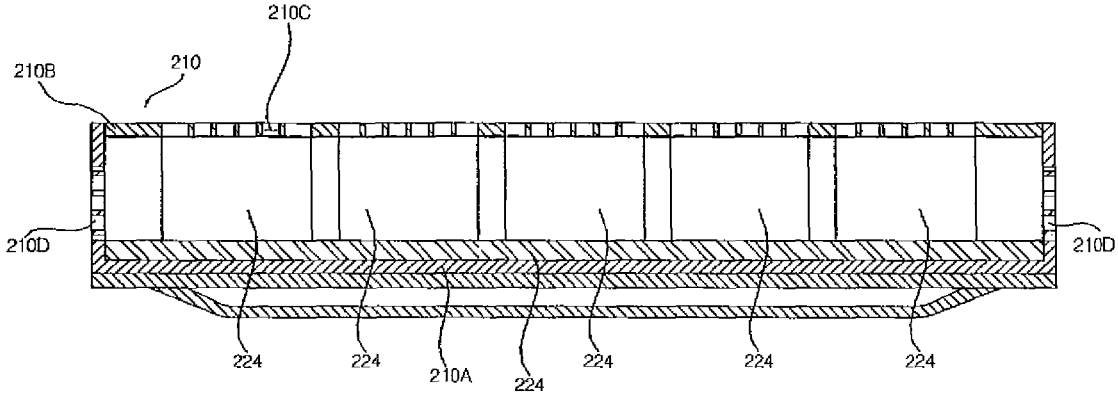
FIG. 13 is a partial cross-sectional view of a cooking apparatus according to the third embodiment of the present invention and is similar to FIG. 7.
Figure 14:
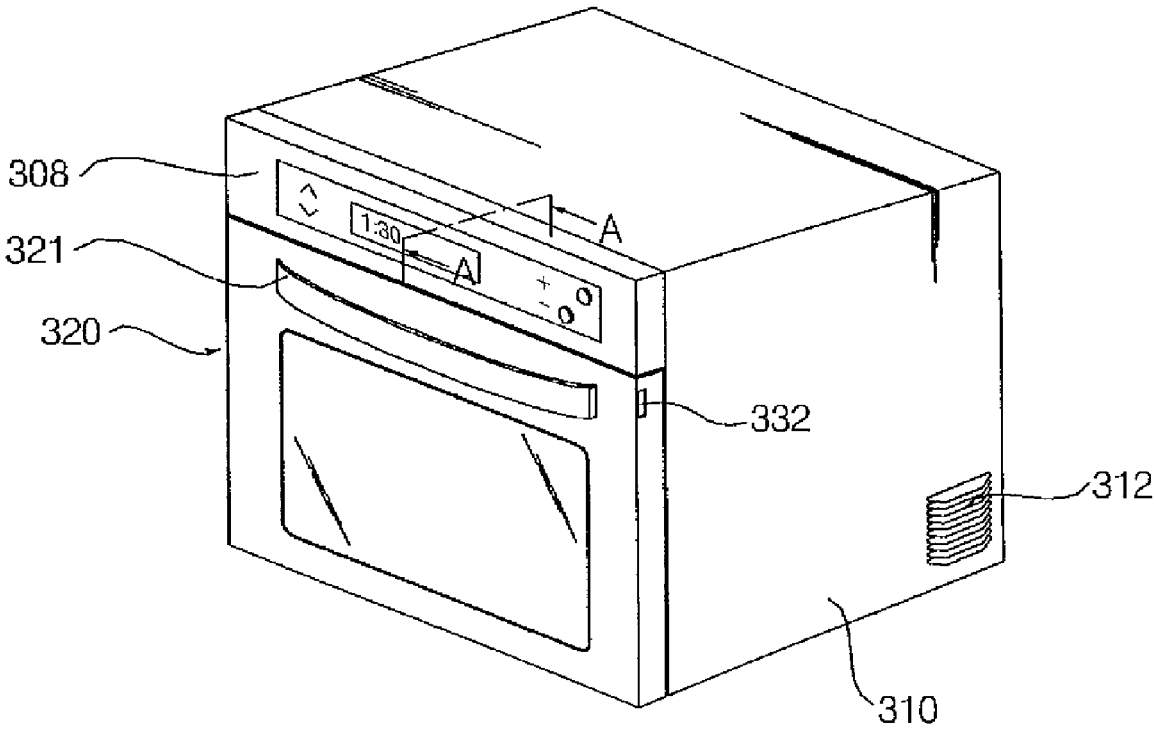
FIG. 14 is a perspective view of an external appearance of a cooking apparatus according to a fourth embodiment of the present invention when the door thereof is closed.
Figure 15:
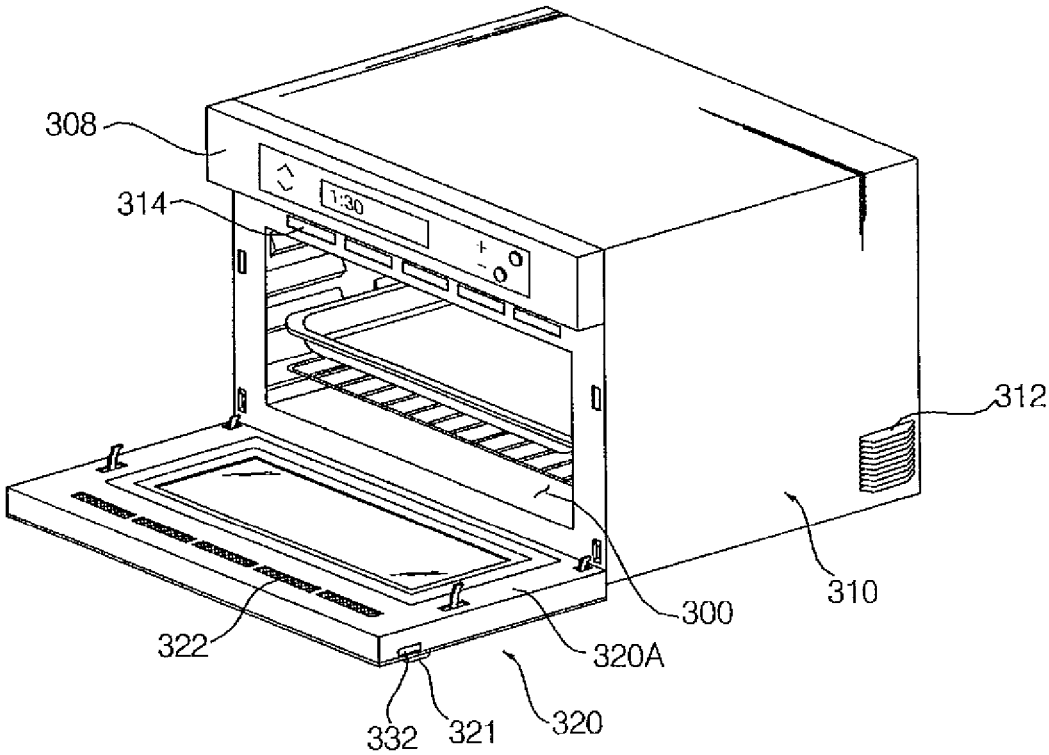
FIG. 15 is a perspective view of an external appearance of a cooking apparatus according to a fourth embodiment of FIG. 15 when the door thereof is opened.

A third exemplary embodiment of the cooking apparatus according to the present invention is shown in FIGS. 11-13. Features of the cooking apparatus according to the exemplary embodiment, with the exception of the door structure, are similar to those described above and thus further description will be omitted unless necessary for the understanding of the invention.

In the cooking apparatus according to this exemplary embodiment, the inside of a cabinet 200 includes a cooking chamber 202, a cooking chamber heat source, a machining room, and a blower to provide cooling airflow. The outside of the cabinet 200 includes a door 210 that opens and closes the cooking chamber 202. A control panel 208 is integrally formed in the door 210. One side of the cabinet 200 includes a cabinet inlet that sucks external air by the blower. The upper side of the front of the cabinet 200 includes a cabinet outlet 200A that is configured to exhaust air in the cabinet 200 by the blower.

The door 210 includes control panel portion 211 in which the control panel 208 is disposed, an air-gap 212 positioned below the control panel portion 211 and capable of allowing the cooling airflow to flow therethrough, and a door base part 214 for viewing the cooking chamber 202 therethrough positioned at the lower side of the air-gap 212, along the length direction of the door 210. The door base part 214 includes an airtight air-gap 214A for viewing the cooking chamber 202 through the door 220. The door 210 includes a door handle 228 positioned opposite to the air-gap 212.

The air-gap 212 and the door base part 214 are divided by a barrier disposed between the air-gap 212 and the door window part 214. A pollutant discharge guide 220 is arranged in the air-gap 212 and will be described below. One side of the air-gap 212 is in communication with the opening 210C formed in the door 210 so that it can be placed in communication with the cabinet outlet 200A when the door 210 is closed. In other words, the opening 210C is located in the inner surface of the door 210, that is, a second door panel 210B of the door 210 nearest the cooking chamber 202. The other side of the air-gap 212 is in communication with openings 210D formed in the door 210 such that the air inside the air-gap 212 is discharged to the outside of the door 210 and the cooking apparatus. The openings 210D can be positioned in the upper side of the air-gap 212 when the door 210 is closed to guide the air inside the air-gap 212 into the control panel 208 and can be positioned in the outer surface of the door 210, that is, at the first panel 210A of the door 210 furthest from the cooking chamber 202. In the present exemplary embodiment, the openings 210D are positioned on the left and right surfaces of the door 200.

The pollutant discharge guide 220 easily discharges the pollutants in the air-gap 212 out of the door 210, in particular, out of the outside of the cooking apparatus. For example, when one of the main pollutants in the air-gap 212 is water vapor generated from the cooking chamber 202 by coming up through a gap between the door 210 and the cabinet 200 and then being infiltrated into the air-gap 212 when the door 210 is closed, the pollutant discharge guide 220 immediately discharges the pollutants in the air-gap 212, such as the water vapor out of the door 210 by the gravity when the door 210 is closed. Specifically, the pollutant discharge guide 220 includes pollutant discharge openings that are formed in the second door panel 210A and a pollutant discharge member 224 that has a sloped surface 222 that causes the pollutants in the air-gap 212 to flow down towards the pollutant discharge openings when the door 210 is closed.

The pollutant discharge opening can be formed in the left and right surfaces of the door 210 or the first door panel 210A so that the pollutants in the air-gap 212 are discharged out of the door 210 and the cooking apparatus and can also be formed in the second door panel 210B so that the pollutants in the air-gap 212 is discharged to the cooking chamber 202. In the present exemplary embodiment, as shown in FIG. 11, the pollutant discharge opening is formed in the second door panel 210B. Further, because the second door panel 210B is provided with the opening 210C connected to the air-gap 212 as described above, the opening 201C can perform the function of the pollutant discharge opening. The sloped surface 222 of the pollutant discharge member 224 can be inclined downwardly from a higher location the first door panel 210A to a lower location on the second door panel 201B. The lower location on the second door panel 201 may be as high as the opening 201C or lower than the opening 201C. In the latter case, some of the pollutants collected in the air-gap 212 may be prevented from returning to the cooking chamber 202.

The pollutant discharge member 224 may include a groove 226 extending towards the opening 210C. The pollutant discharge member 224 is arranged to partition the air-gap 212 and the door base part 214 and may be formed of thermal conductive material so that the door 210 can be cooled by the cooling airflow flowing in the air-gap 212.

When the door 210 is closed, the pollutants in the air-gap 212 flow down to the opening 210C along the pollutant discharge member 224 by gravity. The pollutants flowing down to the opening 210C can be discharged to the cooking chamber 202 through the opening 210C. If the blower is operated, the air exhausted from the cabinet outlet 200A flows in the air-gap 212 through the opening 210C and is then be discharged through the openings 210D. Accordingly, the door 210 and the door handle 228 are cooled and the flow of hot air due to the high temperature of the cooking chamber 202 is interrupted so as not to be transferred to the control panel 208.

A fourth exemplary embodiment of the cooking apparatus according to the present invention is shown in FIGS. 14-18. Features of the cooking apparatus according to the exemplary embodiment, with the exception of the door structure, are similar to those described above and thus further description will be omitted unless necessary for the understanding of the invention.

The cooking apparatus according to the present embodiment includes a cabinet 310 that includes a cooking chamber 300 provided therein, a door 320 located in the front of the cabinet 310 to open and close the cooking chamber 300, and a control panel 308 provided on the upper side of the front of the cabinet 310. As opposed to previous embodiments, the control panel 308 is separate from the door 320 and is positioned above the upper side of the door 320 when the door 320 is in the closed position.

The cabinet 310 includes a cabinet inlet 312 so that external air can be sucked into the cabinet 310 and the front of the cabinet 310 is provided with a cabinet outlet 314 so that the air in the cabinet 310 can be exhausted out of the cabinet 310. The cabinet outlet 314 is positioned below the control panel 308 to avoid interference with the control panel 308.

Figure 16:
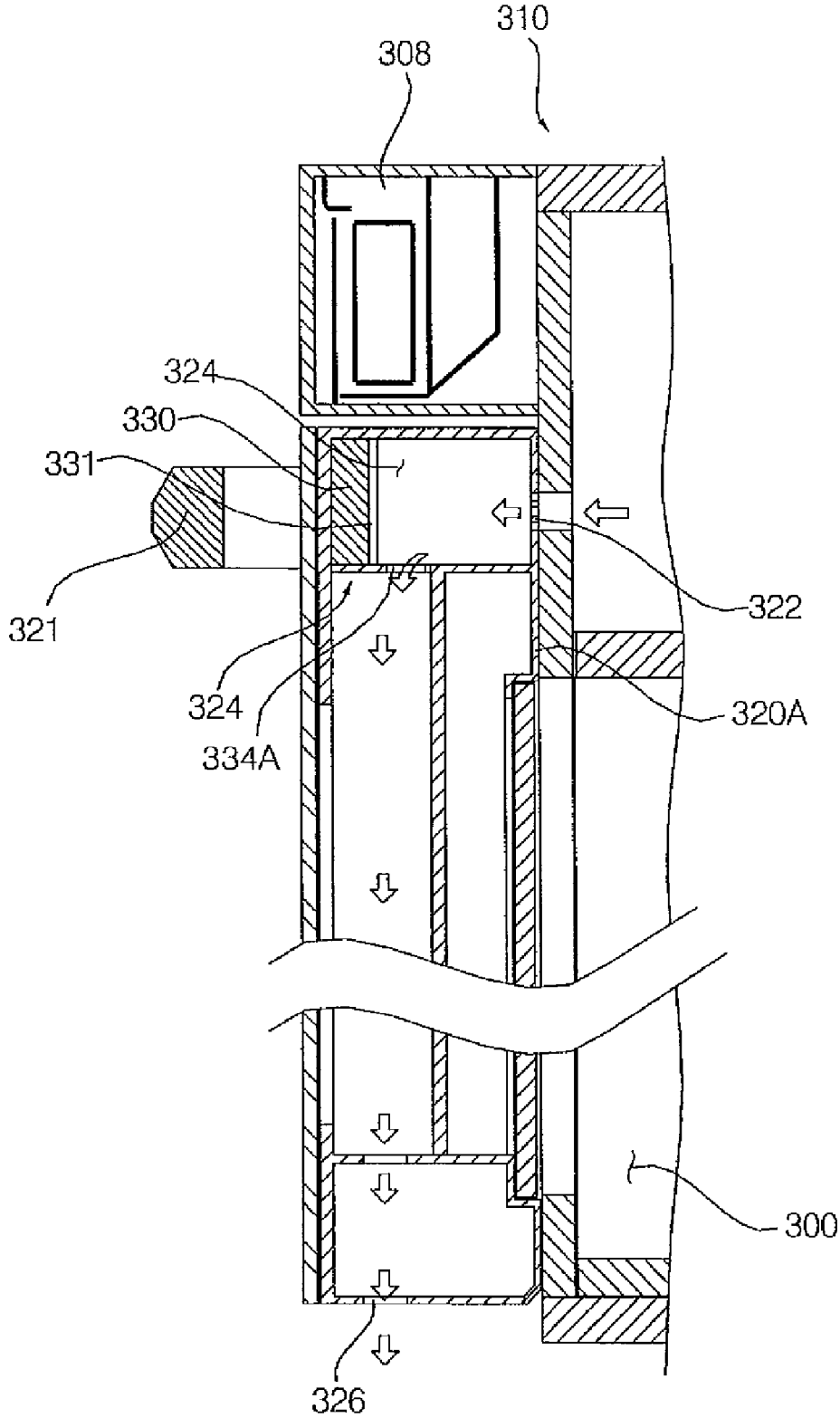
FIG. 16 is a cross-sectional view taken along line A-A in FIG. 14.
Figure 17:
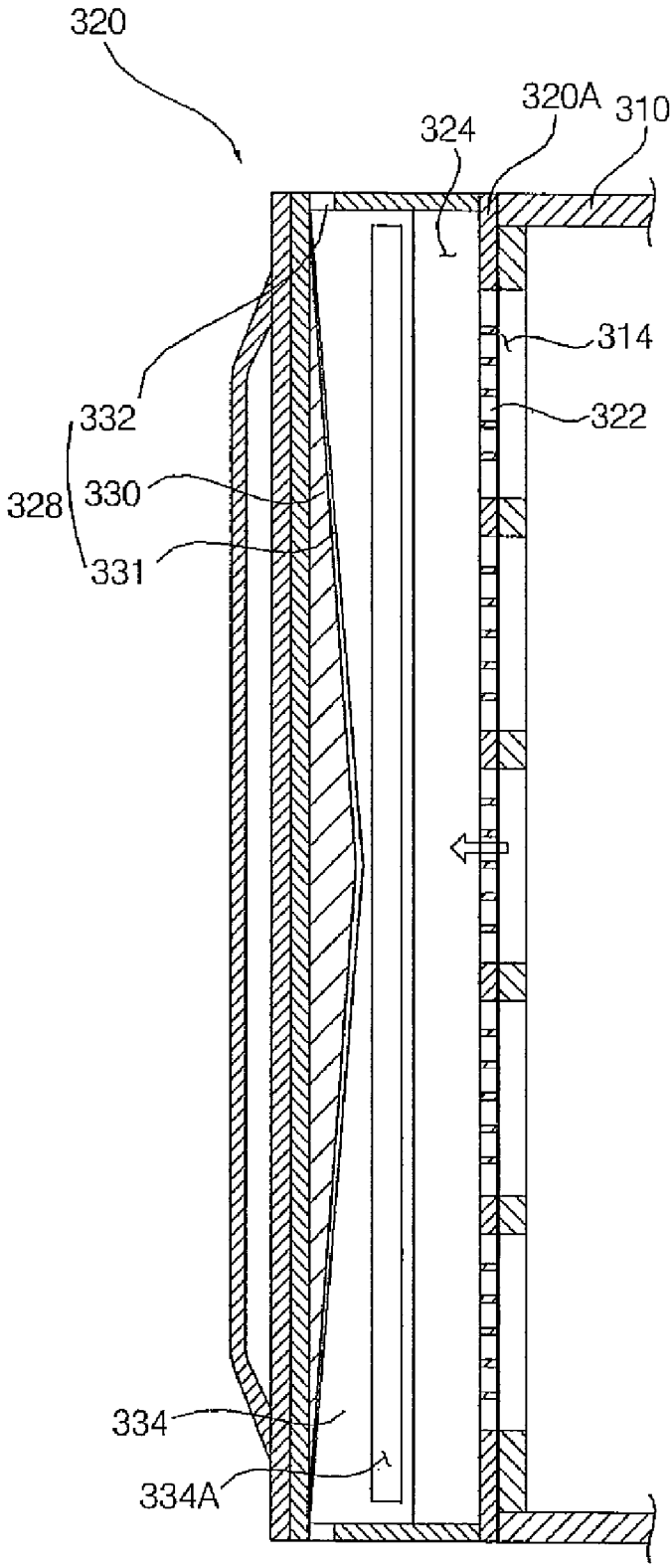
FIG. 17 is a cross-sectional view taken along line B-B in FIG. 14.
Figure 18:
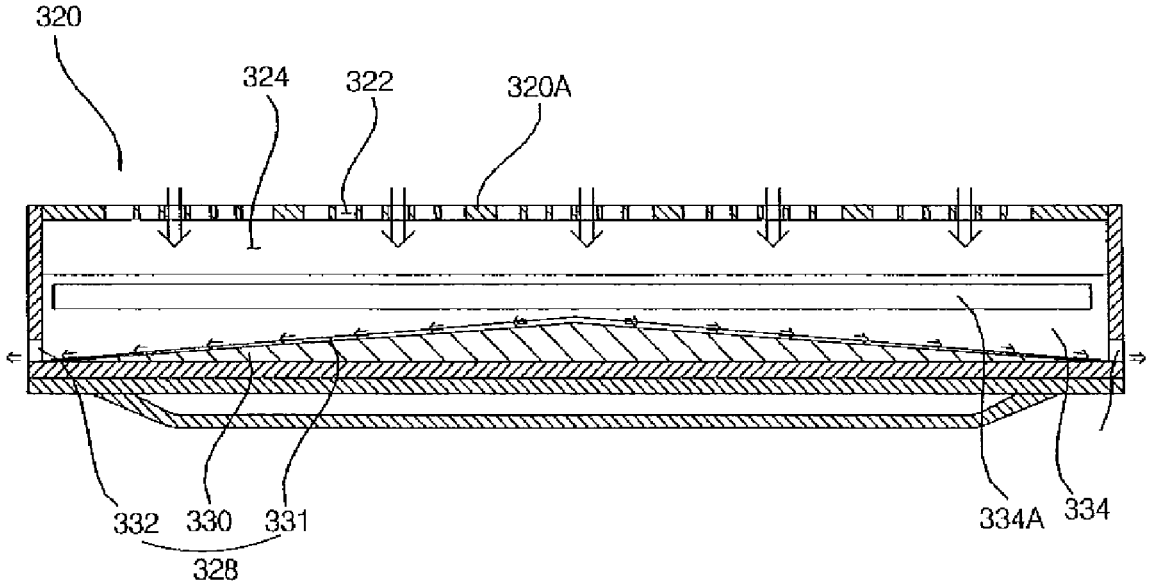
FIG. 18 is a cross-sectional view showing the flow of pollutants through the pollutant discharging unit according to the fourth embodiment of the present invention.

When the door 320 is in the closed position, a opening 322 located in the door 320 is in communication with the cabinet outlet 314 when the door 320 is closed so that the air discharged through the cabinet outlet 314 can flow into the inside of the door 320. The inside of the door 320 includes an air-gap 324 in which one side is connected to the opening 322 in order to allow for the flow of cooling air into the door 320. The door 320 is also provided with a opening 326 connected to other side of the air-gap 324 so that the air inside the air-gap 324 can be discharged out of the door 320, in particular, out of the cooking apparatus. The opening 326 can be spaced from the opening 322 in the length direction of the door 320 or the width direction of the door 320 so that entire parts of the door 320 can be uniformly air-cooled. In this exemplary embodiment, as shown in FIG. 16, when the opening 322 is on the upper side of the door 320, the opening 326 is positioned in the lower side of the door 320.

A pollutant discharge guide 328 is located in an upper part of the air-gap 324 to discharge the pollutants inside the air-gap 324 infiltrated through the opening 322 out of the door 320. The pollutant discharge guide 328 includes a pollutant discharge member 330 provided in the air-gap 324 that extends in the width direction of the door 320 so that the pollutant inside the air-gap 324 can be discharged out of the door 320 by gravity if the door 320 is opened to an approximately horizontal position, and a pollutant discharge opening 332 formed in at least any one of the left and right surfaces of the door 320 and is connected to the pollutant discharge member 330. The pollutant discharge member 330 can be provided with a groove 331 that extends towards the pollutant discharge openings 332.

In addition, the door 320 includes a barrier 334 partitioning the air-gap 324 into a part where the pollutant discharge guide 328 is positioned separate from the rest of the air-gap 324. The barrier 334 includes a barrier panel 334A allowing the pollutants infiltrated through the opening 322 to be collected on the pollutant discharge member 330 and a barrier hole 334B formed in the barrier panel 334A so that the air sucked through the opening 322 can be flowed through the opening 326 along the air-gap 324. The barrier hole 334A is located near the second door panel 320A located nearest the cooking chamber 3300 so that the pollutants collected in the pollutant discharge member 340 are seceded from the pollutant discharge member 340. The barrier 334 is located opposite a door handle 321 and extends in the length direction of the door 320.

When the door 320 is opened to an approximately horizontal position, the pollutants in the air-gap 324 is moved to the pollutant discharge openings 332 along the pollutant discharge member 330 by gravity so that they are discharged out of the door 320 and the cooking apparatus.

If the blower is operated, the external air from the cabinet 310 flows in the inside of the cabinet 310 through the cabinet inlet 312 to coot the inside of the cabinet 310 and can then be discharged through the cabinet outlet 314 out of the cabinet 310. If the door 320 is closed, the air discharged through the cabinet outlet 314 flows into the air-gap 324 through the opening 322 to air-cool the door 320 and is discharged through the opening 326. When the door 320 is air-cooled, the door handle 321 also is cooled and the flow of hot air due to the high temperature of the cooking chamber 302 can be interrupted so as not to be transferred to the control panel 308.

As described above, the cooking apparatus according to the present invention has the advantages that a door is provided with an air-gap so that the air-cooling of the door is possible. The door includes one or more glass panels so that the cooking chamber can be more easily viewed. The door also includes a pollutant discharging unit that discharging the pollutants in the air-gap out of the door by gravity so that the pollutants in the air-gap can be easily removed.

Also, the cooking apparatus according to the present invention has an advantage that the pollutant discharging unit is arranged to discharge the pollutants inside the air-gap by gravity so that there is no need for power such as air pressure for discharging the pollutants in the air-gap, making it possible to simplify the structure, save cost, and facilitate maintenance of the cooking apparatus.

Also, the cooking apparatus according to the present invention has an advantage that the pollutant discharging unit is arranged to discharge the pollutants inside the air-gap by gravity so that the cleaning of the air-gap using washing water can be improved, thereby making it possible to more easily maintain the cleanness of the door. Further, when the cooking apparatus according to the present invention includes the pollutant discharging unit capable of discharging the pollutants in the air-gap into the left and right of the door separately, it has an advantage that the effect of discharging the pollutants in the air-gap is enhanced.

Also, the cooking apparatus according to the present invention has an advantage that the pollutant discharge guide of the pollutant discharging unit includes a groove so that the effect of discharging the pollutants in the air-gap is enhanced.

In addition, the cooking apparatus according to the present invention has the advantages that if the pollutant discharge guide of the pollutant discharging unit is arranged to slope downwards towards the cooking chamber when the door is closed, food particulates or moisture discharged from the cooking chamber to the door flows down to the inner surface of the door and back into the cooking chamber. This assists in preventing the flow of pollutants through the air-gap, making it possible to maintain the cleanness of the door as well as to enhance the convenience of use without needing the cleaning of the inside of the air-gap using washing water, etc.

Also, the cooking apparatus according to the present invention has an advantage that when the barrier partitioning the air-gap into a part where the pollutant discharging unit is positioned and the remaining parts of the air-gap is separated, the pollutants in the air-gap can be contained in the pollutant discharging unit so that the pollutants do not flow to the other portions of the air-gap, thereby maximizing the pollutant discharging process.

Also, the cooking apparatus according to the present invention has an advantage that when the pollutant discharging unit is positioned on the upper side of the door and the barrier is just below the pollutant discharging unit, the barrier can interrupt the flow of hot air to the upper side of the door so that the cooling effect of the door handle and the control panel on the upper side of the door can be improved by the barrier. Further, the cooking apparatus according to the present invention has an advantage that when the barrier is a thermal conductor, the barrier can promote the cooling effect of the door and the handle by thermal conduction.

It will be apparent to those skilled in the art that various modifications and variations can be made in the present invention without departing from the spirit or scope of the invention. Thus, it is intended that this invention covers modifications and variations of the present invention if they come within the scope of the claims and their equivalents. The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A cooking apparatus comprising:
a cooking chamber having an opening;
a cabinet having the cooking chamber located therein, the cabinet including a blowing channel;
a blower generating a blowing force in the blowing channel;
a door configured to open and close the opening of the cooking chamber, the door having an air-gap to receive air discharged from the blowing channel and pollutants generated in the cooking chamber;
at least one pollutant discharge opening formed at the door to discharge at least a portion of the pollutants in the air-gap out of the door; and
a pollutant discharge member having at least one sloped surface sloped downwards towards the at least one pollutant discharge opening in an opening state of the door such that at least the portion of pollutants received in the air-gap are discharged to the at least one pollutant discharge opening by gravity when the door is opened.

2. The cooking apparatus of claim 1, wherein the at least one pollutant discharge opening is located at least one of a left side and a right side of the door.

3. The cooking apparatus of claim 2, wherein the at least one pollutant discharge opening includes a pollutant discharge opening located at each of the left side and the right side of the door, and
wherein the pollutant discharge member includes a left side part in communication with the pollutant discharge opening located at the left side of the door, and a right side part in communication with the pollutant discharge opening located at the right side of the door.

4. The cooking apparatus of claim 2, wherein the door includes a front surface and a back surface spaced from the front surface, and the pollutant discharge member is spaced away from the back surface of the door.

5. The cooking apparatus of claim 2, wherein the pollutant discharge member includes a groove extending along the at least one sloped surface to the at least one pollutant discharge opening.

6. The cooking apparatus of claim 1, further comprising a barrier located under the pollutant discharge member so that the pollutants received in the air-gap are collected on the pollutant discharge member and the barrier, the barrier including a plate.

7. The cooking apparatus of claim 6, wherein the barrier is located such that the flow in the air-gap is not interrupted by the barrier.

8. The cooking apparatus of claim 6, wherein the barrier is formed of a thermal conductive material.

9. The cooking apparatus of claim 6, wherein the door includes a door handle projected from the door in a direction away from the cooking chamber, and the barrier is correspondingly positioned at the door handle.

10. The cooking apparatus of claim 1, wherein the air-gap of the door is in communication with the blowing channel when the door closes the opening of the cooking chamber.

11. The cooking apparatus of claim 10, wherein the cabinet includes a cabinet outlet to allow the blowing channel to be in communication with the air-gap when the door closes the opening of the cooking chamber.

12. The cooking apparatus of claim 10, wherein the door includes:

a first door panel; and a second door panel positioned between the first door panel and the cooking chamber such that the air-gap is located between the second door panel and the first door panel, the second door panel includes an opening such that the air-gap is in communication with the blowing channel when the door closes the opening of the cooking chamber.

13. The cooking apparatus of claim 12, wherein the pollutant discharge member is located in the air-gap opposite the opening in the second door panel.

14. A cooking apparatus comprising:

a cooking chamber having an opening;

a cabinet having the cooking chamber located therein, the cabinet including a blowing channel;

a door configured to open and close the opening of the cooking chamber, the door having a front surface, a back surface, and an air-gap to receive air discharged from the blowing channel and pollutants generated in the cooking chamber;

a hole formed at the door, the hole being in communication with the blowing channel when the door closes the opening of the cooking chamber; and a pollutant discharge member having a sloped surface such that a portion of the pollutants in the air-gap are discharged into the cooking chamber through the hole of the door by gravity when the door closes the opening of the cooking chamber.

15. The cooking apparatus of claim 14, further comprising:

an opening located in the back surface of the door, the opening being in communication with the air-gap.

16. The cooking apparatus of claim 15, wherein the door includes at least one pollutant discharge opening located at least one of a left side and a right side of the door, and the pollutant discharge member includes a groove extending along the sloped surface to be connected to the at least one pollutant discharge opening.

17. The cooking apparatus of claim 14, wherein a barrier is provided near the pollutant discharge member so that the pollutants in the door air-gap are collected on the pollutant discharge member and the barrier.

18. The cooking apparatus of claim 14, wherein the door is hinge-coupled to the cabinet so that it is stood to be approximately vertical to up and down directions when the door is closed to be approximately horizontally disposed to up and down directions when the door is opened.

* * * * *